United States Patent [19]

Hvilsted et al.

[11] Patent Number: 4,846,048

[45] Date of Patent: Jul. 11, 1989

[54] HYDRAULIC CYLINDER WITH PISTON AND WITH A MAGNETIC DEVICE FOR PISTON POSITION DETERMINATION

[75] Inventors: Niels Hvilsted, Sandlodsvej 4, DK-3250 Gilleleje; Kaj Pedersen, Kildehusvej 42, DK-4000 Roskilde; Finn D. Christensen, Lyngby, all of Denmark

[73] Assignees: Niels Hvilsted, Gilleleje, Kaj Pedersen, Roskilde, both of Denmark

[21] Appl. No.: 143,168

[22] PCT Filed: Apr. 14, 1987

[86] PCT No.: PCT/DK87/00039

§ 371 Date: Dec. 29, 1987

§ 102(e) Date: Dec. 29, 1987

[87] PCT Pub. No.: WO87/06656

PCT Pub. Date: Nov. 5, 1987

[30] Foreign Application Priority Data

Apr. 29, 1986 [DK] Denmark ..... 1958/86

[51] Int. Cl.[4] ..... F01B 25/26; F01B 31/12

[52] U.S. Cl. ..... 92/5 R; 324/207; 324/208; 91/DIG. 4

[58] Field of Search ..... 92/5 R; 91/DIG. 4, 1; 73/745, 722, 728; 335/205, 207; 200/82 E, 84 C, 81.9; 338/32 H; 324/207, 208, 251

[56] References Cited

U.S. PATENT DOCUMENTS

| | | | |
|---|---|---|---|
| 3,453,937 | 7/1969 | Haberman | 92/5 R |
| 4,229,696 | 10/1980 | Gustafson | 324/207 |
| 4,316,145 | 2/1982 | Tann | 324/208 |
| 4,401,966 | 8/1983 | Ohmura et al. | 338/32 H |
| 4,419,646 | 12/1983 | Hermle | 324/207 |
| 4,517,514 | 5/1985 | Howell | 324/207 |
| 4,617,451 | 10/1986 | Gibson et al. | 324/207 |
| 4,618,823 | 10/1986 | Dahlheimer et al. | 324/207 |
| 4,652,820 | 3/1987 | Maresca | 324/207 |
| 4,726,282 | 2/1988 | La Bair | 92/5 R |
| 4,736,674 | 4/1988 | Stoll | 92/5 R |

FOREIGN PATENT DOCUMENTS

| | | | |
|---|---|---|---|
| 0108704A1 | 5/1984 | European Pat. Off. . | |
| 2059592 | 6/1971 | Fed. Rep. of Germany . | |
| 2947516 | 11/1979 | Fed. Rep. of Germany . | |
| 0172079 | 8/1986 | Japan | 324/251 |
| 419787 | 8/1981 | Sweden . | |
| 431782 | 2/1984 | Sweden . | |
| 0641277 | 1/1979 | U.S.S.R. | 324/207 |
| 1080372 | 8/1967 | United Kingdom | 324/207 |
| 1148064 | 10/1969 | United Kingdom | 324/207 |
| 2067847 | 7/1981 | United Kingdom | 324/207 |
| 2106984A | 4/1983 | United Kingdom . | |
| 2129879A | 5/1984 | United Kingdom . | |

OTHER PUBLICATIONS

Product Sheet, *Micro Switch,* Micro Switch Corp., Freeport, Ill.

*Primary Examiner*—Robert E. Garrett
*Assistant Examiner*—Thomas Denion
*Attorney, Agent, or Firm*—Saidman, Sterne, Kessler & Goldstein

[57] ABSTRACT

In order to obtain a reliable position determination in a hydraulic cylinder optionally exposed to hard frost, it is suggested to mount a magnetically sensitive component in the form of a Hall-effect transducer in a bore in the cylinder wall and placed between a permanent annular magnet (17) and a magnetically conducting sheet (14). In the middle of the bore a magnetically conducting post (16) is placed and towards the inner side of the cylinder the bore is sealed by a non-magnetic material (19) e.g. brass. The Hall-effect transducer (15) forms thus part of a closed magnetic circuit comprising the permanent magnet (17), the magnetically conducting post (16), the magnetically conducting disc (14) and the hydraulic cylinder wall surrounding the bore. When the piston in the hydraulic cylinder opposes the sensor, a second closed magnetically conducting circuit is formed comprising the permanent magnet, the magnetically conducting post, the piston, and the steel wall of the cylinder. In this way the magnetic field over the Hall-effect transducer is removed and the piston position can be registered by suitable electric detector circuits connected to the Hall-effect transducer.

8 Claims, 2 Drawing Sheets

HYDRAULIC CYLINDER WITH PISTON AND WITH A MAGNETIC DEVICE FOR PISTON POSITION DETERMINATION

TECHNICAL FIELD

The present invention relates to a hydraulic cylinder with a piston slidable in the inner of the cylinder and with magnetic position indication comprising at least one magnetically sensitive component mounted in the cylinder wall.

BACKGROUND ART

It is known to sense the position of a hydraulic piston by means of a magnetic sensor. In the known devices, the permanent magnet is usually mounted in the slidable piston and an inductive sensor is placed at the location in the cylinder wall where a position indication is desired. The known sensors are, however, less reliable in hard frost.

DESCRIPTION OF THE INVENTION

The object of the present invention is to provide a hydraulic cylinder with a reliable, exact, and yet inexpensive position indication which can use a magnetic sensor of the Hall-element type in order to preserve the reliability at low temperatures, as it must be considered that hydraulic cylinders on working machines such as bulldozers and tractors sometimes must work in hard frost.

According to the invention, the cylinder is characterised in that the magnetically sensitive component is embedded in a magnetically essentially non-conducting material and forms part of a first closed magnetic circuit comprising at least one permanent magnet, and that the slidable piston in a predetermined position forms a second closed magnetically better conducting circuit including said permanent magnet(s), but excluding the magnetically sensitive component. When the piston is placed in the position in which an indication is wanted, the steel material of the piston forms part of the second closed magnetic circuit and almost all the magnetic flux passes through the piston. In this situation the first closed circuit with the sensor in the magnetically bad conducting material carries only little flux. The magnetically sensitive component is thereby brought into a first, non-magnetised condition when the piston opposes the position indicator. When the piston is placed elsewhere in the cylinder, the entire magnetic flux will tend to follow the first magnetic circuit so that a magnetic south pole is formed on one side of the magnetically sensitive component and a magnetic north pole on the other side. As a result the component is placed in a magnetic field and is brought into another, magnetised condition which can be registered in electric circuits connected to the sensor circuit.

BRIEF DESCRIPTION OF THE DRAWING

The invention is explained more detailed in the following with reference to the accompanying drawing, in which.

DESCRIPTION OF THE PREFERRED EMBODIMENTS OF THE INVENTION

Figure 1:
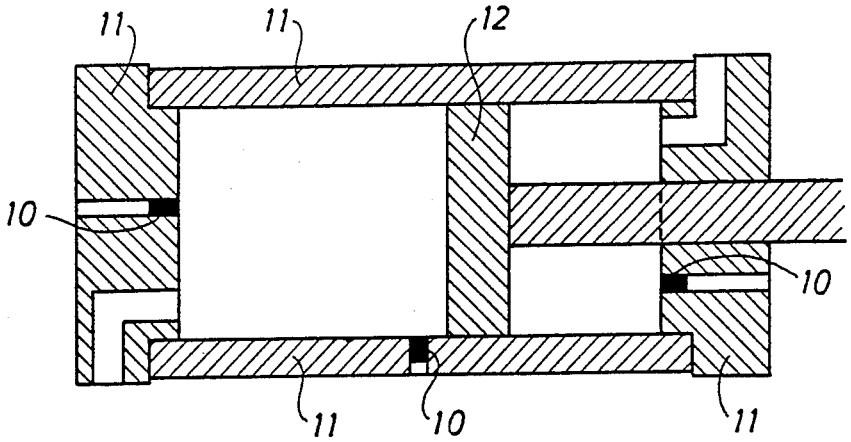
FIG. 1 shows a hydraulic cylinder with several position determination devices according to the invention.

FIG. 1 shows a hydraulic cylinder with several position determination devices according to the invention. These are preferably placed in the bottom members of the cylinder, but may also be placed in the side wall.

Figure 2:
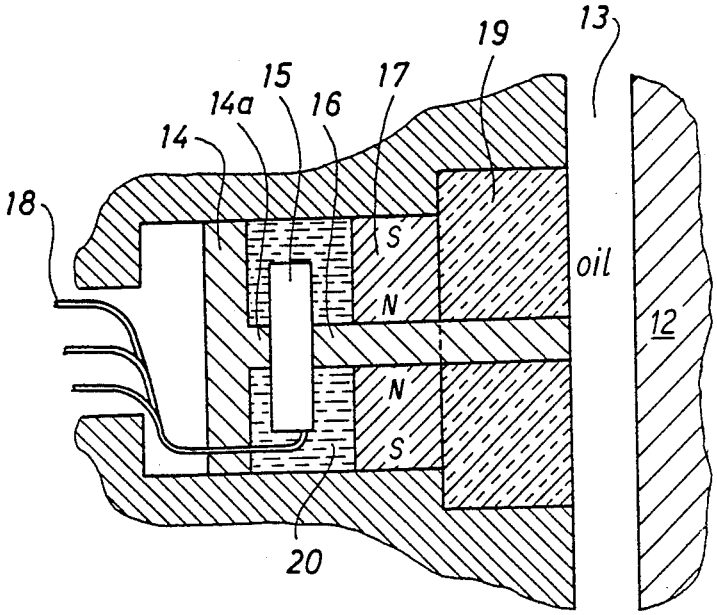
FIG. 2 is an example of the structure of a position determination device according to the invention.

FIG. 2 is a sectional view through a cylinder wall 11 which is preferably the end wall of a cylinder. The pressure of a hydraulic liquid such as oil 13 reciprocates the piston 12. A cylindric bore is provided in the cylinder wall, the position determination device being placed in a tight fit in said bore. It must be emphasized that this type of hydraulic cylinders must be able to handle considerable pressures. The position determination device comprises a magnetic material 14 which at one end forms a circular plate filling the cross section of the bore, said material abutting via a central stem 14*a* an electronic sensor circuit 15 surrounded by non-magnetic material 20, e.g. an epoxy resin. A magnetic post 16 abuts the opposite side of the electronic sensor circuit 15 which is thereby placed between the two magnetic materials 14, 16. A permanent magnet 17 shaped like a disc with a hole in the middle is mounted around the magnetic post 16. The hole fits the magnetic post. The outer circumference of the disc forms one magnetic pole and the central hole form the other magnetic pole. The electronic sensor circuit is connected to electronic control circuits via electric conductors 18, said central circuits not being explained more detailed in the present connection and besides they may be of a known type.

The permanent magnet is covered by a non-magnetic material 19 towards the inner of the cylinder.

Figure 3:
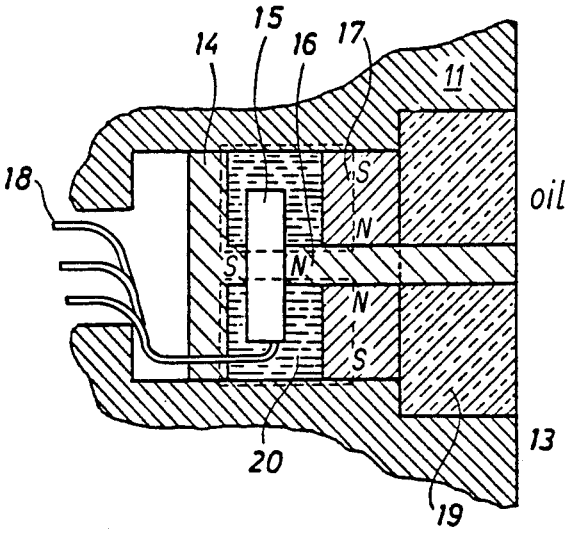
FIG. 3 shows the structure of FIG. 2 with an indication of the magnetic circuit when the piston is displaced from the position determination device.

FIG. 3 illustrates the piston displaced from the position indication device, whereby only the hydraulic liquid e.g. oil 13 being present at the inner surface of the cylinder wall in front of the position indication device. A first magnetic circuit is shown by a dot-and-dash line and comprises the permanent magnet 17, a portion of the magnetic post 16, the sensor circuit 15, the magnetic material 14, and the circuit is closed through the cylinder wall 11 which must be of a magnetic material, preferably steel. In this situation the sensor circuit is thus actuated by the magnetic field and the magnetic circuit is dimensioned so that the main part of the magnetic resistance, i.e. the magnetically hardly conducting material is located at the sensor circuit which then is placed between a magnetic north pole N and a magnetic south pole S which can be registered from the outside through the electric conductors 18.

Figure 4:
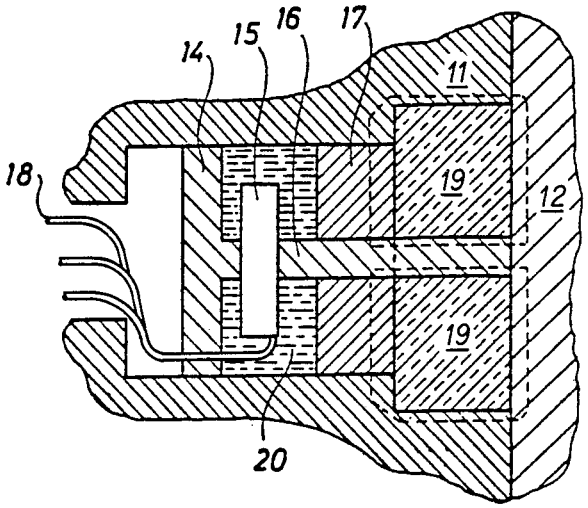
FIG. 4 shows same structure as FIG. 2 and the magnetic circuit when the piston opposes the position determination device.

FIG. 4 illustrates the piston at its dead centre where it fits tightly to the end wall 11 of the cylinder. In this piston position an alternative magnetic circuit will comprise the permanent magnet 17, part of the magnetic post 16, the piston 12 preferably being of steel, and the cylinder wall 11 also of steel. The magnetic circuit surrounds the non-magnetic material 19, e.g. brass. As appears from the FIG., the brass member or ring 19 is preferably of a larger outer diameter than the rest of the position determination device in order to achieve a tight fit around the position determination device, especially in order to tighten the hydraulic cylinder, which may be exposed to high pressures. The alternative magnetic circuit shown here must be dimensioned with a low magnetic resistance in other words with a high permeability so that the magnetic field strength across the sensor circuit 15 in the first circuit becomes so low that the sensor circuit changes state which can be registered from the outside through electric conductors 18.

The magnetic sensor described here is temperature independent in a wide range of temperatures when using an appropriate sensor circuit and furthermore a great security against leakages is obtained as the device shown can be made very tight. At a suitable dimensioning, a good accuracy is obtained and the device is substantially less expensive than the position determination devices used today. A Hall-effect transducer typically working in a range of temperature from −40° to +150° C. can be used as sensor circuit.

The term of material "steel" used in this application refers to steel alloys magnetizable and preferably soft magnetic steel alloys.

We claim:

1. A hydraulic cylinder with a piston slidable in the cylinder and with magnetic position indication comprising at least one magnetically sensitive component mounted in the cylinder wall, characterized in that the magnetically sensitive component is embedded in a magnetically essentially non-conducting material and forms part of a first closed magnetic circuit comprising at least one permanent magnet, and that in a predetermined position to be indicated, the piston forms a second closed magnetically better conducting circuit including the permanent magnet, but excluding the magnetically sensitive component.

2. A cylinder as claimed in claim 1, wherein the permanent magnet (17) is annular and that the inner and the outer cylindrical surfaces of the magnet constitute opposite poles (N, S).

3. A cylinder as in claim 2, wherein the cylindric bore in the cylinder wall is substantially perpendicular to the inner surface of the cylinder adjacent to the piston position to be indicated, the cylindric bore comprising a circular, magnetic flux guiding material disc of an outer diameter fitting the diameter of the bore, that the magnetically sensitive component is mounted centrally in the bore substantially surrounded by magnetically essentially non-conducting material, such as an epoxy resin, the magnetically sensitive component abutting a substantially central magnetic flux guiding material adjacent to the disc and on its opposite side abutting a magnetic flux guiding rod shaped material extending along the centre axis of the cylindric bore from the component to the inner surface of the hydraulic cylinder through the annular magnet whose centre hole in this way is filled with a magnetic flux guiding material.

4. A cylinder as claimed in claim 1, wherein the first magnetic circuit further comprises a section of the cylinder wall along the surface of the bore in the cylinder wall, a magnetic flux guiding material disc, and a central magnetic flux guiding material extending from the disc to the magnetically sensitive component, and;

wherein the second magnetic circuit comprises the permanent magnet, a section of the cylinder wall along the surface of the bore in the cylinder wall, a section of the piston, and a magnetic flux guiding rod shaped material, extending from the surface of the cylinder wall and back to the permanent magnet.

5. A cylinder as claimed in claim 3, wherein the magnetic flux guiding material disc and central magnetic flux guiding material constitute one piece.

6. A cylinder as claimed in claim 3, wherein that part of the cylindric bore in the cylinder wall adjacent to the inner surface of the cylinder wall has a larger diameter than does the remainder of the cylindric bore, and that this larger part of the cylindric bore is filled with magnetically essentially non-conducting material such as brass, the essentially non-conducting material having a through going opening which can receive the magnetic flux guiding rod shaped material, the essentially non-conducting material having an outer circumference forming a tight fit with the bore.

7. A cylinder as claimed in claim 3, wherein the magnetic flux guiding rod shaped material is made of a soft magnetic material.

8. A cylinder as claimed in claim 3 or 5, wherein the magnetic flux guiding material disc and/or the the central magnetic flux guiding material is/are made of a soft magnetic material.

* * * * *